US005819902A

United States Patent [19]

Schöneweiss et al.

[11] Patent Number: 5,819,902

[45] Date of Patent: Oct. 13, 1998

[54] SAFETY DEVICE FOR ESCALATORS

[75] Inventors: Klaus Schöneweiss; Jerzy Welnic, both of Hattingen, Germany

[73] Assignee: O&K Rolltreppen GmbH & Co. KG, Hattingen, Germany

[21] Appl. No.: 804,479

[22] Filed: Feb. 21, 1997

[30] Foreign Application Priority Data

Feb. 21, 1996 [DE] Germany ..... 196 06 317.5

[51] Int. Cl.[6] ..... B66B 5/02

[52] U.S. Cl. ..... 198/323

[58] Field of Search ..... 198/323

[56] References Cited

U.S. PATENT DOCUMENTS

| | | | |
|---|---|---|---|
| 4,638,901 | 1/1987 | Lunardi | 198/323 |
| 4,863,006 | 9/1989 | Kotkata et al. | 198/323 |

FOREIGN PATENT DOCUMENTS

| | | |
|---|---|---|
| PS-0 082 074 | 6/1986 | Austria . |
| B 307 557 | 3/1989 | European Pat. Off. . |

OTHER PUBLICATIONS

JP–A–53–16290, Abstracts of Japan.

*Primary Examiner*—Joseph E. Valenza
*Assistant Examiner*—Khoi H. Tran
*Attorney, Agent, or Firm*—Spencer & Frank

[57] ABSTRACT

An arrangement is provided for monitoring at least one of raising and lowering of individual steps of a band of steps of an escalator The escalator includes guide rails for the steps, a driving gear, and endless driving chains provided in a region of balustrade bases and being driven by the driving gear. The guide rails have a transition curve from a horizontal run to a vertical run. Each step includes rollers supported on the guide rails and is held between the endless driving chains. A safety device is disposed essentially in the transition curve for switching off the driving gear. The safety device comprises a spring-activated first component positioned below the band of steps at a predeterminable distance to the continuously running steps and extending in a direction of the steps; a switch-off device coupled to the driving gear for switching off the driving gear, the first component being operatively coupled to the switch-off device; and a second component disposed in a region of the steps and being responsive to a raising or lowering of one of the steps in the transition curve for causing deflection of the first component, which deflection activates the switch-off device for switching off the drive gear.

12 Claims, 6 Drawing Sheets

SAFETY DEVICE FOR ESCALATORS

CROSS-REFERENCE TO RELATED APPLICATIONS

The present application claims the right of foreign priority with respect to Application No. 196 06 317.5 -22 filed in Germany on Feb. 21, 1996, the subject matter of which is incorporated herein by reference.

BACKGROUND OF THE INVENTION

The invention relates to a device for monitoring the raising and/or lowering of individual steps of a band of steps for escalators, wherein the steps are equipped with rollers supported on guide rails and are held between endless drive chains that are provided in the base region of the balustrades, wherein at least one safety device is provided essentially in the transition curve from the horizontal to the diagonal run, and in particular stops the escalator driving gear.

There are a number of danger points with a continuously running band of steps for an escalator, particularly with respect to the failure of individual running steps. Furthermore, it can happen, for example, that the tires of a baby carriage, or shoes, are pulled into the gap between successive running steps, so that a relative displacement of one running step with respect to another one occurs. In both cases, the escalator must be stopped immediately to avoid damage to property or injury to person.

European patent application No, EP-B 307 557 concerns a switch-off device for an escalator, to initiate the stopping of an endless band of steps, wherein the escalator is composed of several steps and two step chains arranged to the side of the steps, which band is guided between two balustrade bases, has an approach that can be stepped on, with two horizontal runs, a diagonal run and two transition curves. The switch-off device becomes effective immediately if a faulty operation of the band of steps or a defect in the band of steps is detected. An electronic evaluation circuit, including a light barrier which emits and receives a light beam transverse to the running direction of the band of steps, is fixedly installed on the balustrade bases for the escalator, respectively, at the transition for the lower and upper transition curve for the diagonal run of the band of steps, above the step chains and below the stair treads that can be stepped on. At least one recess, which can be traversed by the light beam of the light barrier during a passing by of the steps, is provided in the side regions for each step.

SUMMARY OF THE INVENTION

It is an object of the invention to further modify a safety device of the generic type so that it is possible to monitor the raising as well as the lowering of the steps of a band of steps in a structurally simple way with one and the same device.

The above and other objects are accomplished according to the invention by the provision of an arrangement for monitoring at least one of raising and lowering of individual steps of a band of steps of an escalator, the escalator including guide rails for the steps, a driving gear, and endless driving chains provided in a region of balustrade bases and being driven by the driving gear, the guide rails having a transition curve from a horizontal run to a vertical run, wherein each step includes rollers supported on the guide rails and is held between the endless driving chains, the arrangement comprising: a safety device disposed essentially in the transition curve for switching off the driving gear, the safety device comprising a spring-activated first component positioned below the band of steps at a predeterminable distance to the continuously running steps and extending in a direction of the steps with a switch-off device coupled to the driving gear for switching off the driving gear, the first component being operatively coupled to the switch-off device and a second component disposed in a region of the steps and being responsive to a raising or lowering of one of the steps in the transition curve for causing deflection of the first component, which deflection activates the switch-off device for switching off the driving gear.

The invention thus makes it possible to use one and the same safety device for monitoring a relative displacement of individual steps against each other (raising) as well as a failure of individual steps (lowering). As a result of this, the complete arrangement has a simpler structural design and can thus be produced more cost-effectively.

Exemplary embodiments of the inventive subject are shown in the Figures and are described as follows.

DETAILED DESCRIPTION OF THE INVENTION

Figure 1:
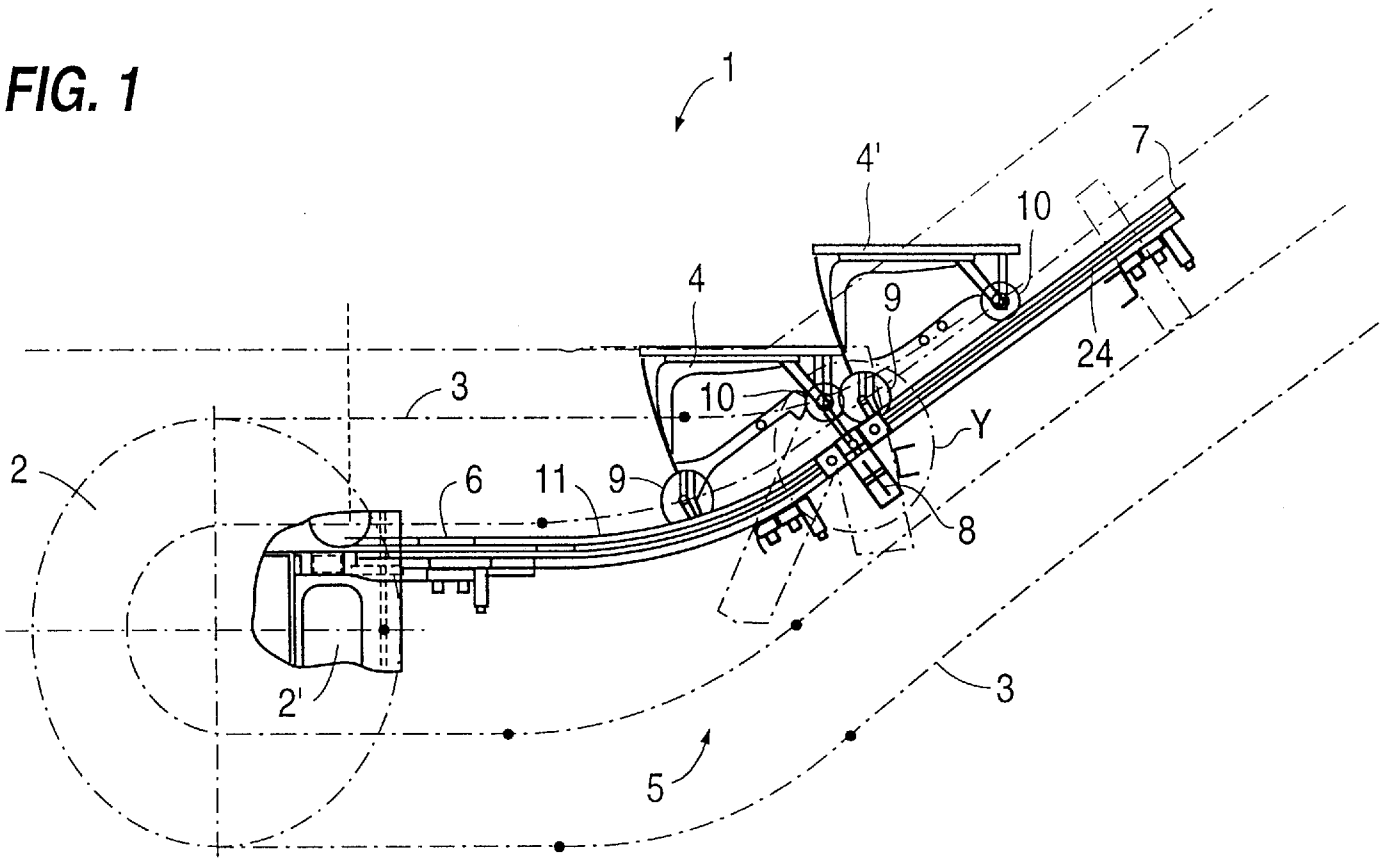
FIG. 1 is a schematic, partial side view of a band of steps for an escalator in a normal state.

Referring to FIG. 1, there is shown a partial view of an escalator 1, including a lower deflection wheel 2 for a schematically indicated traction element 3, steps 4, 4' of a transition region 5 from a horizontal run 6 to a diagonal run 7 of the escalator, and a safety device 8 that is only generally indicated in FIG. 1 and not shown in detail. Steps 4, 4' include rollers 9, 10, which support themselves on a guide rail 11 with a curved run. A profile 24 with a U-shaped cross section open to the outside is provided in transition region 5 so that an accessible interior free space is defined by the legs of the U-shaped profile Devices for deflecting the safety device 8 (not seen in FIG. 1) are provided in the region for rollers 9 and, during the normal state for the escalator 1, can be guided inside of the free space between the legs of profile 24, without making contact with the legs of profile 24. Further shown, but only schematically, is the driving gear 2' electrically connected to the safety device 8.

Figure 2:
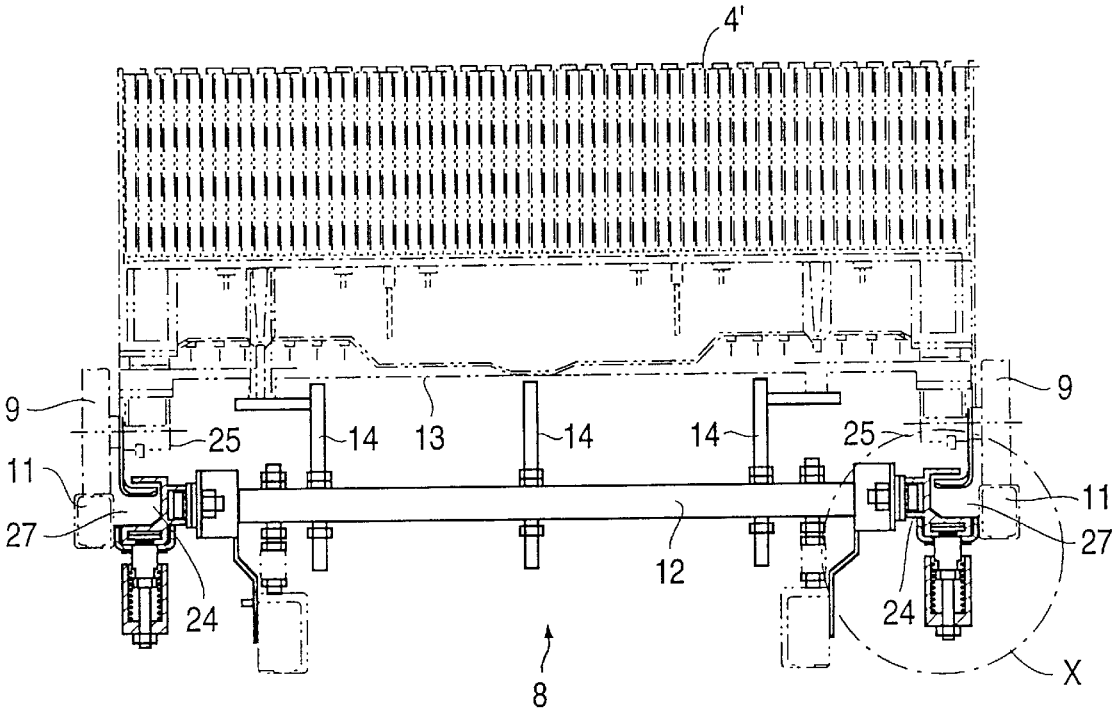
FIG. 2 is a front view of the steps in FIG. 1 during a passage through the safety device according to the invention.

FIG. 2 provides a view of the inside of safety device 8, wherein a step 4' with hinged rollers 9 that are Supported on guide rails 11 can be seen. Guide rails 11 are attached to balustrade bases for escalator 1, which are not shown in detail.

Safety device 8 essentially comprises a holding element 12 as a first component extending in horizontal direction below steps 4' in transition region 5, which operates jointly with several rod-type components 14 that extend vertically, essentially in the direction of a lower edge 13 of step 4 and which are at a defined distance to lower edge 13. Holding element 12 is mounted in a manner to be directly spring-activated via additional elements that are described in more detail with respect to FIG. 3.

As mentioned previously, profile 24 with U-shaped cross section is open to the outside, meaning in the direction of the balustrade base that cannot be seen. Profile 24 is fixedly installed at holding element 12 and operates jointly and in a spring-activated manner with elements as further described below. Arranged on an axis 25 of each roller 9 is a gripping device 26 having an L-shaped cross section. L-shaped gripping device 26 has a shorter leg that projects through the open side of profile 24 into the interior free space 27 of profile 24, wherein during a normal escalator state, there is no contact whatsoever between profile 24 and gripping device 26. Profile 24 is provided exclusively in the transition regions from the horizontal to diagonal runs of the escalator since the steps are raised or lowered there. The second component is built by parts 24 and 26 in combination with the spring element 16 as shown in FIG. 3.

Figure 3:
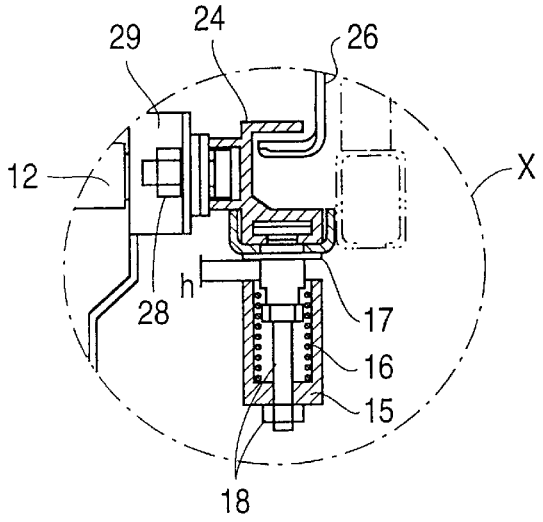
FIG. 3 is an enlarged representation of the region X according to FIG. 2.

FIG. 3 shows a partial view X according to FIG. 2, in which a directly spring-activated positioning of holding element 12 can be seen. In this embodiment components 14 are thus indirectly spring-activated since they operate jointly with holding element 12. A slightly prestressed spring 16 is arranged inside a pot-shaped component 15, which is supported at one end on the bottom of pot-shaped component 15 and at its opposite end on an element 17 that is attached to profile 24. The prestressing of spring 16 can be varied by means of a screw-bolt connection 18. Profile 24 itself, as shown, is connected by a screw 23 and another component 29 with holding element 12. During the normal state of operation of the escalator, a defined gap h exists between the free end of pot 15 and element 17. Also recognizable is the gripping device 26, for which the shorter leg has a predetermined distance to the corresponding leg of U-shaped profile 24.

Figure 4:
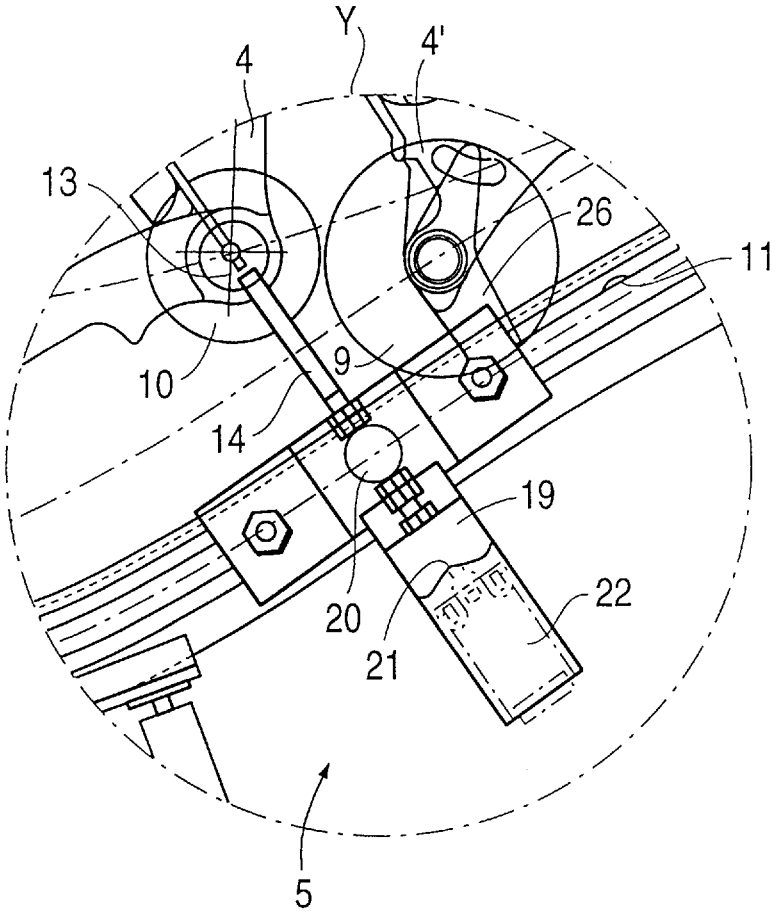
FIG. 4 is an enlarged representation of the region Y according to FIG. 1.

FIG. 4 shows a partial view Y according to FIG. 1, wherein rear roller 9 for step 4' with gripping device 26 attached and step 4 are shown in transition region 5 of guide rail 11. FIG. 4 additionally shows lower edge 13 of step 4, one of the rod-shaped components 14, which has a connecting link 19 in a region of its free end and can swing around a horizontal axis 20. Below connecting link 19, a limit switch 22 includes a key 21 which is used to stop the driving gear (not shown) for the escalator as discussed below. As already mentioned, FIGS. 1 to 4 represent the normal state for an escalator 1, without breaks in the individual steps 4, 4' or vertical relative movements between the individual steps.

Figure 5:
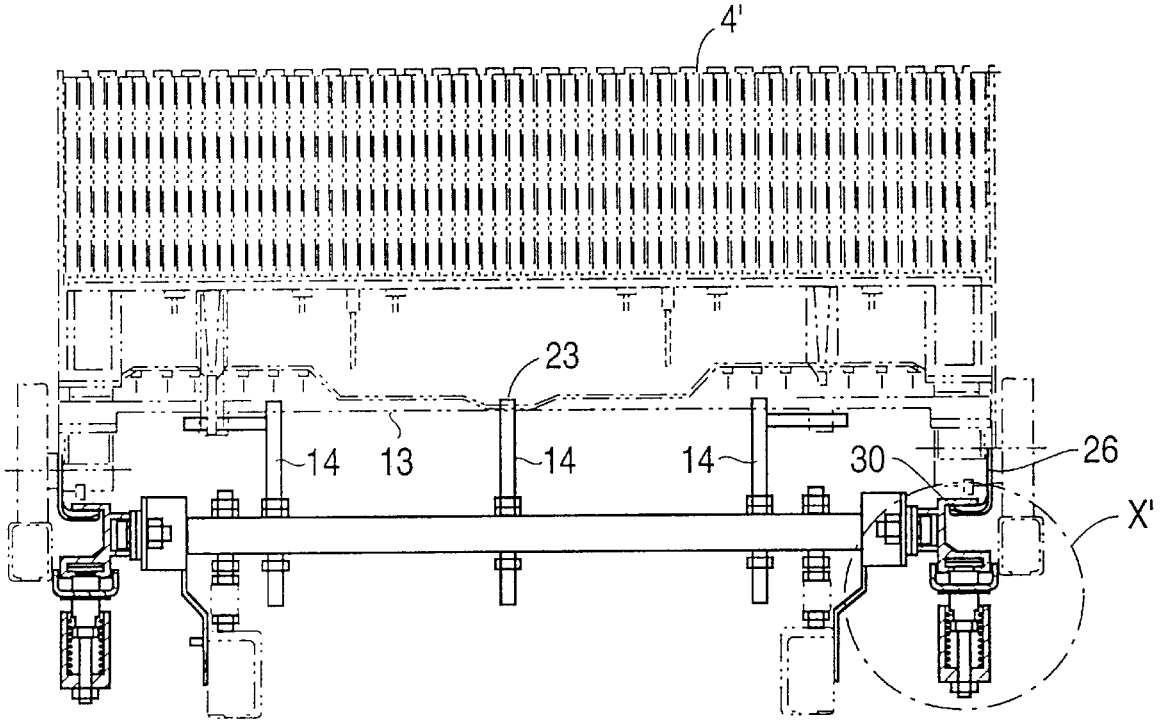
FIG. 5 is a front view similar to FIG. 2 with a step in a raised state.
Figure 6:
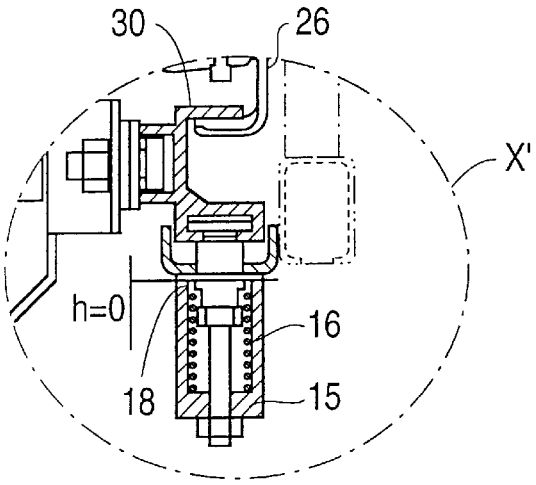
FIG. 6 is an enlarged view of region X' according to FIG. 5.
Figure 7:
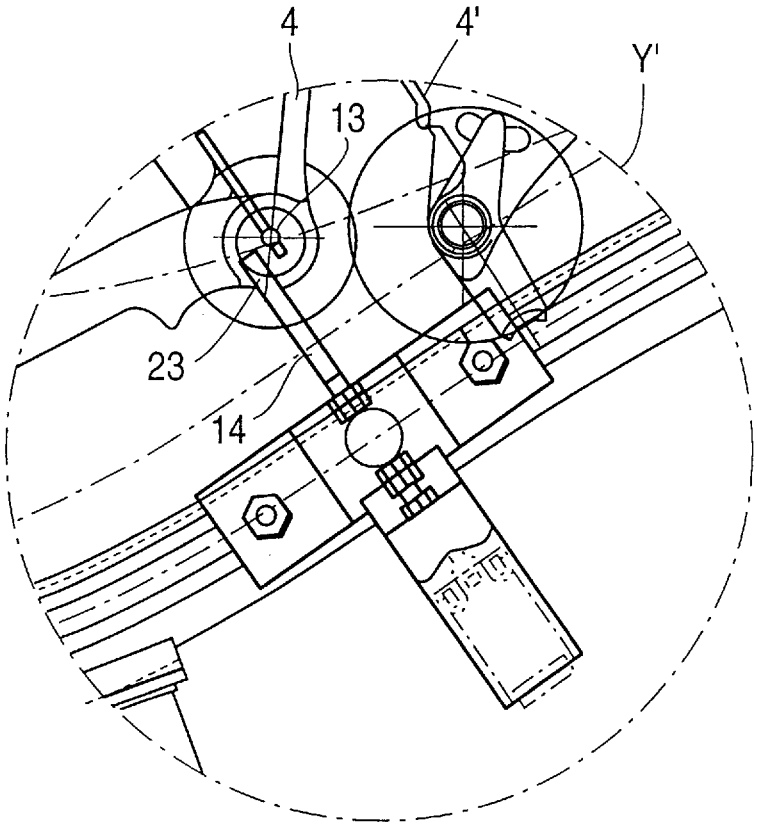
FIG. 7 is an enlarged view of a region Y' similar to FIG. 4 but with a raised step wherein the switching operation has not yet been initiated.

FIGS. 5 to 7 show representations that correspond to the state of a raised step 4, wherein a switching operation has not yet been initiated. It can be seen that lower edge 13 of step 4 no longer conforms to the spacing as shown in FIGS. 2 and 4, so that a collision of lower edge 13 with the free end 23 of rod-shaped components 14 will occur. Springs 16 are compressed inside pot 15, so that the element 17 now comes to rest on the corresponding front surface of pot 15. Since no contact has yet occurred between the end regions 13 and 23, no deflection of the rod-shaped component 14 has occurred yet either, which would result in a shutting down of the escalator. As can be seen in particular in FIGS. 5 and 6, the shorter leg of the gripping device 26 now rests against the corresponding leg of profile 24 in a region 30.

Figure 8:
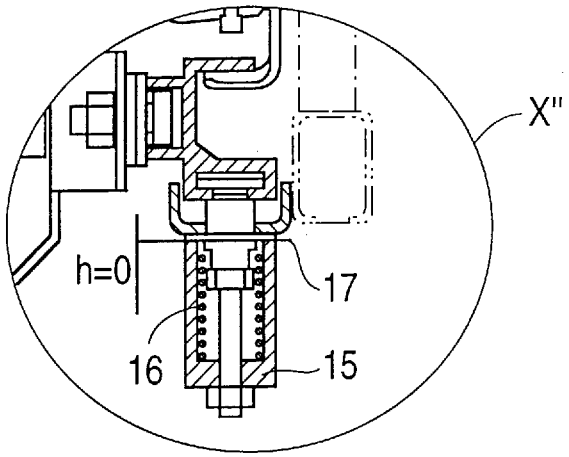
FIG. 8 is a partial view X" similar to FIG. 6 with the switching operation having been initiated.
Figure 9:
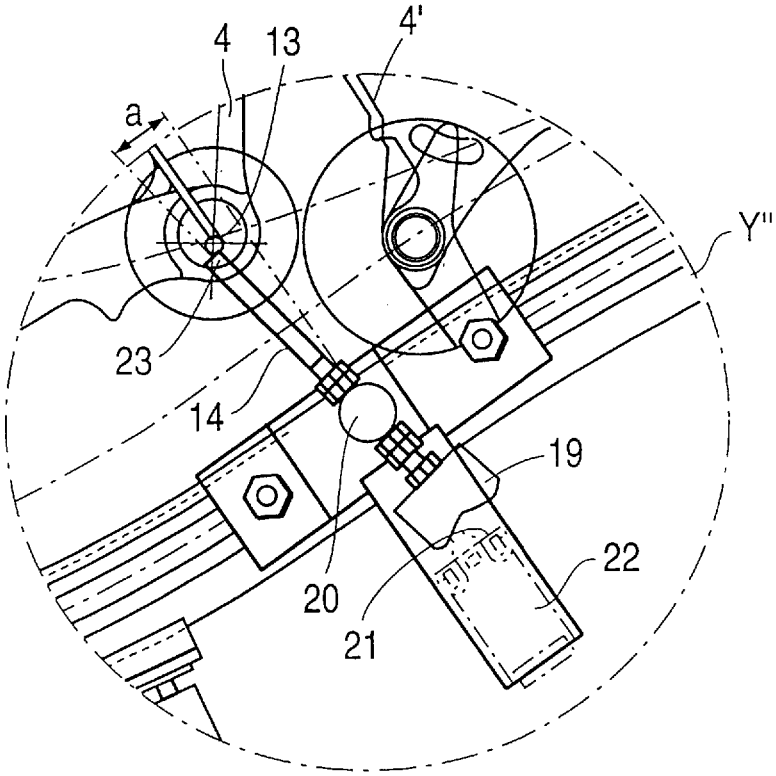
FIG. 9 is a partial view Y" similar to FIG. 7 with the switching operation having been initiated.

FIGS. 8 and 9 show the state operation in which the step is raised and the switching operation has been initiated. The distance between element 17 and the front surface of pot 15 continues to be h=0, so that springs 16 continue to be compressed. The lower edge 13 of step 4 now comes to rest against free end 23 of at least one of the rod-shaped components 14, so that it will be deflected around its horizonal axis 20. The connecting link 19 is deflected in an equivalent way, so that the key 21 of the limit switch 22 is actuated, which results in the stopping of the driving gear for the escalator.

FIGS. 2 to 9 only show the situation when step 4 is raised via the gripping device 26 in combination with the profile 24 being connected to the holding element 12. Holding element 12 includes the rod-type components 14 and will be moved then in direction of the lower edge 13 of strip 4.

When lowering step 4, especially when it is broken, lower edge 13 comes into contact with the end region 23 of one or more of the rod-type components 14. The same situation as indicated in FIGS. 7 to 9 will happen here, too. The rod-type component 14 will be deflected around the horizontal axis 20. The connecting link 18 is deflected in an equivalent way, in that the key 21 of the limit switch 22 is activated, which results in the electrical stopping of the driving gear 2' of the escalator.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. An arrangement for monitoring at least one of raising and lowering of individual steps of a band of steps of an escalator, the escalator including guide rails for the steps, a driving gear, and endless driving chains provided in a region of balustrade bases and being driven by the driving gear, the guide rails having a transition curve from a horizontal run to a vertical run, wherein each step includes rollers supported on the guide rails and is held between the endless driving chains, the arrangement comprising:

a safety device disposed essentially in the transition curve for switching off the driving gear, the safety device comprising:

a spring-activated first component positioned below the band of steps at a predeterminable distance to the continuously running steps and extending in a direction of the steps;

a switch-off device coupled to the driving gear for switching off the driving gear, the first component being operatively coupled to the switch-off device; and a second component disposed in a region of the steps and being responsive to a raising or lowering of one of the steps in the transition curve for causing deflection of the first component, which deflection activates the switch-off device for switching off the drive gear.

2. An arrangement according to claim 1, wherein the first component includes a holding element suspended in a spring-activated manner opposite the steps, and wherein the first component comprises a plurality of further components mounted jointly on the holding element and being spring-activated via the holding element.

3. An arrangement according to claim 2, and further including spring elements disposed on both sides of the further components.

4. An arrangement according to claim 2, further including spring elements disposed on both sides of the holding element.

5. An arrangement according to claim 1, wherein the second component includes approximately U-shaped profiles arranged in the transition region of the guide rails, respectively, and being open in a direction of the balustrade bases to define an accessible interior free space, and gripping devices disposed in the region of the steps being guided within the free space of the profiles, respectively.

6. An arrangement according to claim 5, wherein the rollers each have a rotational axis and each gripping device is arranged on a respective one of the rotational axes.

7. An arrangement according to claim 5, wherein the profiles are arranged inwardly of a respective one of the guide rails.

8. An arrangement according to claim 5, further comprising a holding element having opposite sides connected to the profiles via corresponding connecting components.

9. An arrangement according to claim 4, further including a pot-shaped component attached to a profile at an end of the holding element, and the spring elements comprise prestressed spring elements arranged inside of the pot-shaped components and supported at one end by a bottom of the pot-shaped element and at another end by an element connected to the profile, wherein a defined gap (h) exists between a top surface of the pot-shaped element and the element connected to the profile during a normal state for the band of steps.

10. An arrangement according to claim 2, wherein the further components have a rod-shaped design.

11. An arrangement according to the claim 10, wherein the further components are swivelable around a horizonal axis.

12. An arrangement according to the claim 1, wherein the switch off device includes a limit switch, a connecting element, and further component having free ends connected with the connecting element which in turn operates jointly via a key with the limit switch to switch off the escalator driving gear.

* * * * *